United States Patent [19]

Lorenz et al.

[11] Patent Number: 4,960,978

[45] Date of Patent: Oct. 2, 1990

[54] COOKING APPLIANCE

[75] Inventors: Josef Lorenz; Robert Kicherer, both of Oberderdingen, Fed. Rep. of Germany

[73] Assignee: E.G.O. Elektro-Gerate Blanc u. Fischer, Fed. Rep. of Germany

[21] Appl. No.: 314,000

[22] Filed: Feb. 22, 1989

[51] Int. Cl.[5] ..... H05B 3/70

[52] U.S. Cl. ..... 219/455; 219/465; 219/459

[58] Field of Search ..... 219/455, 543, 457, 462, 219/463, 464, 465, 467, 459

[56] References Cited

U.S. PATENT DOCUMENTS

| | | | |
|---|---|---|---|
| 2,640,906 | 6/1953 | Haynes | 219/464 |
| 3,694,627 | 9/1972 | Blatchford | 219/543 |
| 3,848,111 | 11/1974 | Brouneus | 219/464 |
| 3,883,719 | 5/1975 | Hurko | 219/464 |
| 3,895,216 | 7/1975 | Hurko | 219/464 |
| 4,032,750 | 6/1977 | Hurko | 219/464 |
| 4,057,707 | 11/1977 | Allen | 219/543 |
| 4,073,970 | 2/1978 | Allen | 427/96 |
| 4,527,050 | 7/1985 | Kicherer | 219/464 |
| 4,843,218 | 6/1989 | Husslein | 219/457 |

FOREIGN PATENT DOCUMENTS

| | | |
|---|---|---|
| 0069298 | 1/1983 | European Pat. Off. . |
| 2615064 | 10/1977 | Fed. Rep. of Germany . |
| 3545442 | 6/1987 | Fed. Rep. of Germany . |
| 3545443 | 6/1987 | Fed. Rep. of Germany . |
| 3545454 | 7/1987 | Fed. Rep. of Germany . |
| 1280278 | 2/1961 | France . |
| 2187836 | 9/1987 | United Kingdom . |

*Primary Examiner*—Teresa J. Walberg

*Attorney, Agent, or Firm*—Eckert, Seamans, Cherin & Mellott

[57] ABSTRACT

An electric cooking appliance has a sheet steel, glass, ceramic or glass ceramic carrier plate (15), to whose underside are applied for electrical heating purposes thick film resistors (16). It can be constructed as a large-area plate with several cooking points, or as an individual hotplate, which is received in a mounting rim (26). Temperature limitation and regulation sensors (22) are applied in the form of film resistance sensors to the underside of the carrier plate.

19 Claims, 3 Drawing Sheets

COOKING APPLIANCE

The invention relates to a cooking appliance either in the form of an overall appliance, e.g. with a continuous cooking surface covering several cooking points, or comprising individual hotplates to be inserted in an oven or a hob.

SUMMARY OF THE INVENTION

An object of the invention is to further improve such a hotplate an/or its heating means.

The invention provides a hotplate having one or more of the inventive features described hereinafter, which can be used singly or in the form of random subcombinations for the realization of the invention.

The hotplate carrier can be made from metal, particularly sheet metal and preferably chrome steel. Chrome steel types 1.4742 and 1.4016 have proved particularly suitable. However, the hotplate carrier can also be made from glass, e.g. quartz glass, or ceramic, e.g. based on aluminum titanate, aluminium nitride or silicon nitride, as well as from glass ceramic. In place of quartz glass, it is also possible to use quartz material, whose optical characteristics differ from quartz glass, but which is not very important in the present case. It is also possible to use composite materials, e.g. a metal with a dielectric insulating layer applied to the bottom of it and/or with enamelling on the upper surface. Particularly in the case of chrome steel carrier plates, it is preferred to provide the hotplate surface with a dark, temperature-resistant enamel, because chrome steel can discolor at the temperatures which occur and this cannot be accepted from the standpoint of appearance.

However, as stated, these carrier plates can be used as individual hotplates or overall plates with zonally fitted heating means below the same. In the case of chrome steel plates, preference is given to the construction as a single plate, to prevent warping.

Heating advantageously takes place through thick film resistors, which are directly applied to the underside of the carrier in the case of insulating carriers, whereas in the case of conductive or becoming conductive and with the heating system-incompatible materials are applied to a corresponding intermediate layer. The thick film resistors can be applied by screen process printing, by scraping or by an ink jet application method of the said carrier. They are either very thin films, optionally arranged in meander from to give the necessary resistance and provided with good conducting metals, e.g. having a silver, copper, nickel or aluminum base, or can be used in the form of true resistance films, through which the current then flows in large-area form and e.g. based on ruthenium. The conductive components are provided in fritted glass or other pulverulent or pasty media, which can also contain oxides as binders, which are applied by the aforementioned processes and finally melted or stove heated on. A dielectric coating optionally provided on the carrier as a composite or intermediate coating can be provided in the same process as a thin glass film applied in paste form.

The connections or terminals are advantageously provided by means of soldered on pins with an enlarged contact plate. The brazing solder is constituted by a metal-filled glass paste, which is preferably applied to the contact point by screen process printing. As a result an e.g. nickel bolt at the intended contact surface can be directly soldered to the thick film resistor using a brazing process able to withstand high temperatures. A strand can be fixed to the connecting bolt by a conventional welding process.

The temperature limitation or control can advantageously take place mechanically or electronically. As sensors thin film temperature sensors can be fitted to the carrier, e.g. in the form of sensor layers with positive or negative thermal resistance characteristics (PTC or NTC sensors). The advantageous fitting of several sensors at different locations of the carrier and/or one or more sensors determining the temperature in large-area manner can also detect temperature differences within the carrier, which makes it possible to provide an automatic cooking system with saucepan detection. Account is taken of whether a saucepan absorbs little power, e.g. due to its uneven bottom or due to a small filling quantity.

Temperature limitation by means of said preferably printed-on sensors must advantageously take place in such a way that there can be no warping or thermal overloading of the carrier. In the case of metal carriers, particularly if they are relatively thin, the main problem is warping, but this can be counteracted by choosing a material with a low expansion coefficient. An appropriate temperature limit is between 350° and 500° C., preferably between 400° and 450° C. These temperatures make it possible to carry out all cooking and roasting processes and any warping is limited. This more particularly applies in the case of hotplates, which transmit heat preferably by contact, whereas radiant heated hotplates are partly exposed at their underside to higher temperatures, which extend up to the admissible temperature limit of over 600° C. for glass ceramic. However, the temperature can here again be reliably detected and limited by means of printed-on sensors.

Standard hotplate geometries are possible, e.g. circular shapes and all other appropriate shapes, such as elongated, oval or polygonal shapes. It is also possible to have two-circuit constructions, e.g. in the form of two concentric and independently switchable cooking points, which permit adaptation to different saucepan sizes, as well as shapes having a central circular cooking zone and on one or both sides thereof switch-in heating points extending the cooking surface to give it an elongated shape.

It is also possible to subdivide the carrier into areas with different basic temperature settings or different settability, which are e.g. provided for roasting, cooking and warming. Also in the case of individual hotplates an almost planar construction is possible, i.e. in which the mounting or trim plate surrounding the individual plate is fitted at approximately the same height.

The sealing between the individual hotplates and the hob or mounting plate can take place by silicone seals or, particularly in conjunction with a metal edge or frame, by fusible glass. The plate which is e.g. itself made from glass or ceramic can be so fused or bonded by a low melting glass with the ring surrounding it that absolute through-flow security is ensured. For the rim, plate and optionally also the fusible glass, preference is given to the use of a material with a comparable or identical expansion coefficient, while taking account of the temperatures occurring at the individual points.

When using a substantially transparent or translucent carrier plate, the thick film conductor and/or a colored layer located below it, e.g. a backing insulating layer, can serve as decoration. This makes it possible to very adequately optically indicate the particular cooking point.

As a result of the low mass and low thermal inertia of the components participating in the heating and the good thermal conductivity (in the case of chrome steel metallic thermal conductivity and in the same of glass high radiant proportion), particularly high efficiency is obtained. Compared with conventional heating means, an efficiency improvement of over 50% has been obtained.

Advantageously the thermal insulation to the bottom takes place through a thermal insulation mat or an insulating material molding, there preferably being a distance of a few millimeters, preferably approximately 2 mm between the thick film resistor and the mat and in which there can be stagnant air or a vacuum. The decorative coating on the side remote from the carrier plate, i.e. below the heating conductor, can simultaneously serve as protection for the latter.

Embodiments of the invention are described in greater detail hereinafter relative to the drawings, wherein are shown:

FIG. 1: A plan view of a cooking appliance.

FIGS. 2 to 7: Partial cross-sections through individual hotplates fitted into a mounting plate.

FIG. 8: A detail of a hotplate connection.

DETAILED DESCRIPTION OF THE PREFERRED EMBODIMENTS

Figure 1:
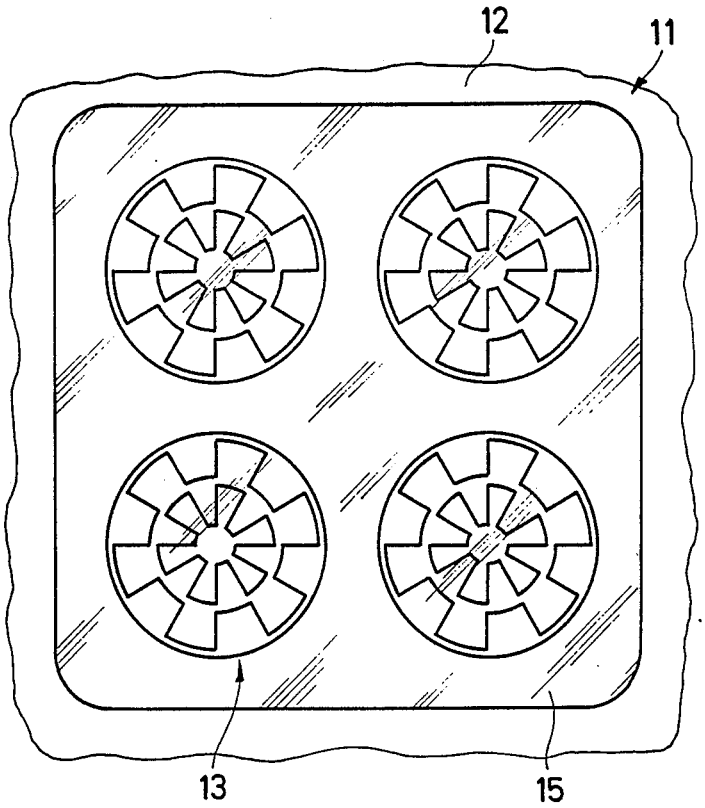

FIG. 1 is a plan view of a cooking appliance 11 with a mounting or built-in or trim plate 15, which is fitted in a working plate 12, e.g. the upper cover plate of an item of kitchen furniture. This mounting plate 15 is of glass ceramic provided on the underside, optionally accompanied by the interposing of a glass insulating layer, with four heating points 13 with in each case two concentric heating resistors in the form of a thick film resistor. The drawing shows the decoration of the hotplate top surface with in each case two concentric, independently operatable areas.

Figure 2:
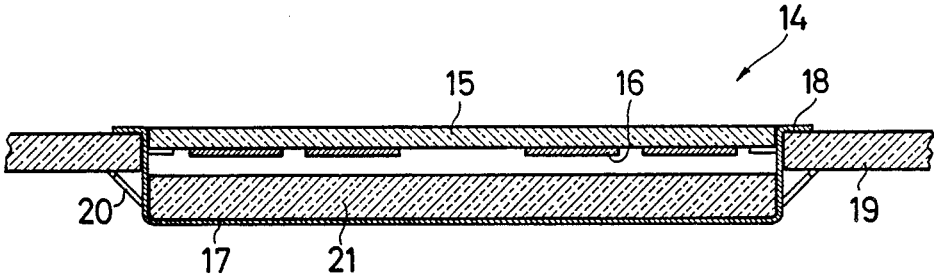

FIG. 2 is a section through an individual cooking point 14, which comprises an upper quartz glass carrier plate 15, to whose underside are fitted by coating thick film resistors 16. The carrier plate 15 is located in the rim of a carrier shell 17, which is mounted with a projecting rim 18 on the edge of the opening in a mounting plate 19 and is supported there on the underside by means of spring elements 20. The mounting plate can e.g. be of hardened glass, but can also be of enamelled sheet steel of V2A steel. Thermal insulation 21 is placed in the flat carrier shell at a distance from the underside of the heating means 16.

Figure 3:
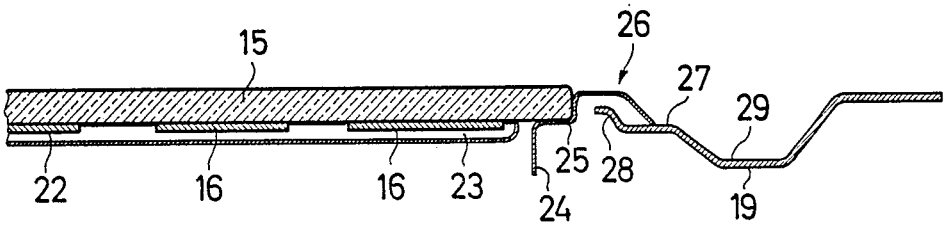

FIG. 3 also shows a quartz glass carrier plate 15 and to whose underside is directly applied a thick film resistor 16 in several areas, e.g. for providing a two-circuit plate. A sensor 22 for temperature regulation and/or limitation is fitted in the same way to the underside. The entire back surface is covered by a colored protective layer 23, which can also glimmer through the quartz glass plate. On the edge or rim the carrier plate 15 is received in a stainless steel sheet rim, which has on the inside a downwardly projecting dripping rim 24, a reception angle or bend 25 for the edge of the carrier plate and a downwardly projecting flange 26, which is initially substantially horizontal and then downwardly inclined under an angle and rests on a shoulder of a mounting plate 19, which is made from shaped metal sheeting. To the inside of shoulder 27 is connected an upwardly directed sill 28 and to its outside a depression 29. In the vicinity of the reception angle 25, the rim of carrier plate 15 is fixed by melting or fusing by means of fusible glass produced from glass paste.

Figure 4:
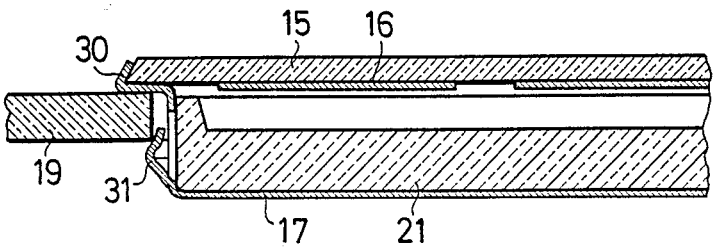

FIG. 4 shows a construction in which the rim of the carrier plate 15 is downwardly conically widened and surrounded by a marginal area 30 of carrier shell 17, accompanied by the interposing of a silicone seal. The engagement of the mounting plate 19, which can once again be made from a hardened glass, is provided by means of a silicone seal. The carrier shell 17 is fixed in the opening of mounting plate 19 by resilient tongues 31, which snap in behind the opening rim on pressing the unit into the mounting opening.

Figure 5:
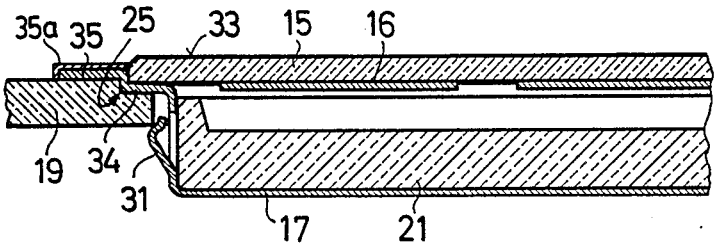

FIG. 5 shows a corresponding construction, in which for reducing the fitting height of the cooking surface 33 with respect to the surface of the mounting plate 19, the latter is provided in the opening area with an upper all-round depression 34, in which can be inserted the reception angle 25. The horizontally extending, upper, outer flange 35 of the carrier shell rests on the mounting plate surface and can comprise a steel sheet having an enamel layer **35*a*. The reception of the heating carrier plate 15 in the reception angle 25** takes place in much the same way as in FIG. 3, but the said angle is not as deep as the carrier plate is thick and for this purpose the latter is bevelled in the marginal area.

Figure 6:
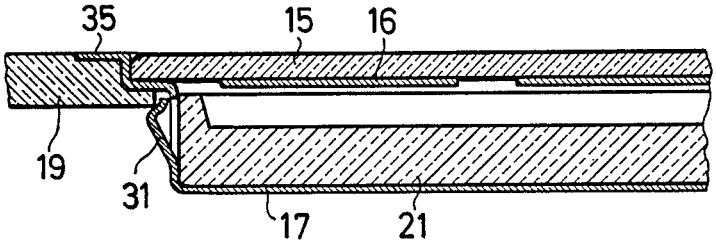

FIG. 6 shows a construction corresponding to FIG. 5 in which, as in all the constructions, the same parts are given the same reference numerals and a further description thereof is not provided. The marginal flange 35 is embedded in the mounting plate 19.

Figure 7:
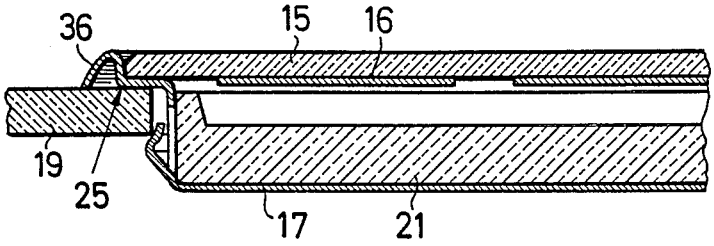

FIG. 7 shows a construction in which the carrier plate 15, while interposing the reception angle 25, rests on the mounting plate 19, because it has a larger diameter than the mounting opening. The outer rim 36 of the carrier shell 17 is downwardly inclined and rests on the surface of the mounting plate.

Figure 8:
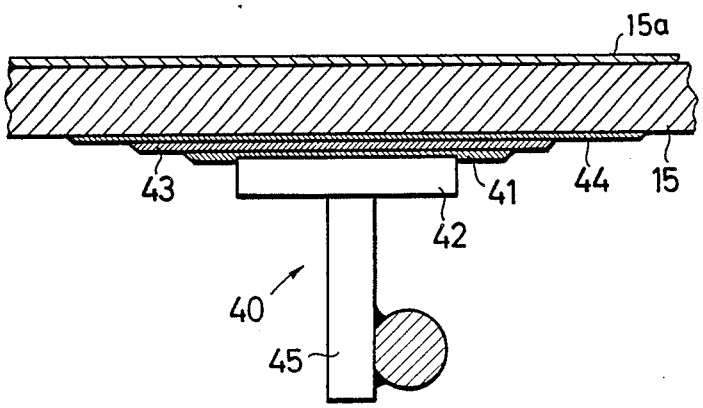

FIG. 8 shows in greatly enlarged form a preferably nickel connecting bolt 40, which is soldered by means of a brazing layer 41 with a plate-like fixing portion 42 to a contact surface 43 belonging to the thick film resistance heating means 16. With the interposing of a glass-like insulating layer 44, heating means 16 is applied to an e.g. chrome steel carrier or cooking plate 15, having an upper enamel layer **15*a*. The individual layers have the compositions given hereinbefore, preference being given for the brazing solder to a glass paste filled with high-quantity metal, for the resistance layer 16 to a ruthenium-based layer in fritted glass and for the insulating layer 44 to a glass layer, all being successively applied by fusing or stove heating, following application by the screen printing process or some other application process. A connecting wire 46 is welded to the relatively thin connecting pin 45** of the bolt projecting from the plate-like contact surface.

We claim:

1. A cooking appliance, comprising:

a carrier plate having an underside;

at least one electric heating means applied to the underside of the carrier plate, the heating means including film resistor means with a resistance layer including a glass melt and defining a contact area; and, electric connection means applied to the film resistor means, including a metal bolt having an enlarged bearing surface, which is fastened by means of a metal-filled-glass brazing solder to the contact area.

2. A cooking appliance, comprising:

a carrier plate having an underside;

at least one electric heating means applied to the underside of the carrier plate and including film resistor means; and, a sheet metal mounting ring surrounding the carrier plate and being bonded to the carrier plate by a fritted glass material.

3. Cooking appliance according to claims 1 or 2, wherein the carrier plate is made from metal.

4. Cooking appliance according to claim 3, wherein the carrier plate is made from a high-grade steel sheet.

5. Cooking appliance according to claim 4, wherein the carrier plate is made from a chrome steel sheet.

6. Cooking appliance according to claims 1 or 2, wherein an insulating intermediate layer is applied to the underside of the carrier plate.

7. Cooking appliance according to claim 6, wherein the intermediate layer includes a glass melt.

8. Cooking appliance according to claims 1 or 2, wherein the carrier plate is made from a material selected from the group glass, ceramic, and glass ceramic, and incorporates at least one cooking field.

9. Cooking appliance according to claim 8, wherein the carrier plate is an individual hotplate.

10. Cooking appliance according to claim 8, wherein the carrier plate is a plate covering a plurality of individually operable cooking fields.

11. Cooking appliance according to claim 2, further comprising a hotplate containing several independently operable heating means including said film resistor means, which heating means are adjacent to each other to form zones which are juxtaposed.

12. Cooking appliance according to claim 2, wherein the carrier plate is made of metal which is enamelled.

13. Cooking appliance according to claim 2, wherein a mounting ring surrounding the carrier plate is enamelled.

14. Cooking appliance according to claim 2, further comprising a hotplate containing several independently operable heating means including said film resistor means, which heating means are adjacent to each other to form zones which surround each other.

15. Cooking appliance according to claim 2, wherein a decorative layer is provided on a side of the heating means remote from the carrier plate protecting the film resistor.

16. Cooking appliance according to claim 15, wherein the decorative layer also covers parts of the carrier plate not provided with film resistor.

17. Cooking appliance according to claim 1, wherein at least one temperature sensor including film resistor means are applied for temperature regulation and limitation purposes to the underside of the carrier plate.

18. Cooking appliance according to claim 17, wherein a plurality of said sensors are provided at different points of the carrier plate.

19. Cooking appliance according to claim 17, wherein sensors are positioned as to detect in larger-area manner several parts of the carrier plate.

* * * * *